US005167680A

United States Patent [19]

Gardner

[11] Patent Number: 5,167,680

[45] Date of Patent: Dec. 1, 1992

[54] VACUUM CLEANER BAG ASSEMBLY

[75] Inventor: John Gardner, Fountain Valley, Calif.

[73] Assignee: Figgie International Inc., Willoughby, Ohio

[21] Appl. No.: 842,254

[22] Filed: Feb. 27, 1992

[51] Int. Cl.[5] ..... B01D 46/02

[52] U.S. Cl. ..... 55/373; 55/381; 55/502; 55/508; 55/DIG. 2

[58] Field of Search ..... 55/373, 381, 382, 492, 55/501, 502, 508, 511, DIG. 2

[56] References Cited

U.S. PATENT DOCUMENTS

| | | | |
|---|---|---|---|
| 3,747,305 | 7/1973 | O'Dell et al. | 55/381 X |
| 3,937,621 | 2/1976 | Gravley | 55/381 X |
| 4,105,421 | 8/1978 | Rheinfrank et al. | 55/381 X |
| 4,185,976 | 1/1980 | Kosik et al. | 55/373 |

FOREIGN PATENT DOCUMENTS

| | | | |
|---|---|---|---|
| 0879781 | 10/1961 | United Kingdom | 55/373 |

*Primary Examiner*—Charles Hart

*Attorney, Agent, or Firm*—Senniger, Powers, Leavitt & Roedel

[57] ABSTRACT

A bag assembly for a vacuum cleaner of the type having a housing defining a bag-receiving compartment, and a lid for closing an opening in the housing above the bag-receiving compartment. The bag assembly comprises a bag having a side wall with upper edge margins defining a bag mouth, and an annular bag support of synthetic resin material. The bag support has an annular wall with a generally vertical central axis, and an annular sealing formation adjacent the top of the wall. The upper edge margins of the bag are stitched to the annular wall of the bag support to provide a seal between the wall and the bag around the mouth of the bag. The bag assembly is placed in the bag-receiving compartment of the vacuum cleaner and the lid moved to a closed position in which the annular sealing formation on the bag support is sealingly engageable with the housing.

16 Claims, 3 Drawing Sheets

VACUUM CLEANER BAG ASSEMBLY

BACKGROUND OF THE INVENTION

This invention relates generally to a bag assembly, and more particularly to a dust bag assembly for use in a vacuum cleaner.

This invention is especially (although not exclusively) directed to a dust bag assembly for use in a vacuum cleaner of the type sold under the trademark "Tri Star" by Interstate Engineering, a division of Figgie International Inc. The dust bag assembly used in this type of cleaning system is generally depicted in FIG. 1, with the bag assembly being shown in position within a bag-receiving compartment of a vacuum cleaner. As illustrated best in FIG. 2, the bag assembly presently in use comprises a cloth bag 1, a metal ring 2 having a cylindric wall 3 with a radial flange 4 at its upper edge, and an annular formation 5 with a recess 6 for receiving the radial flange of the ring 2. In this design the upper edge margins of the cloth bag are glued to the outside surface of the cylindric wall of the ring to secure the bag in place and to provide a seal between the bag and the ring.

While this prior design has proven to be generally satisfactory, the glue seal between the bag and the metal ring of the bag assembly has certain drawbacks, both from the standpoint of assembly and the standpoint of performance. With respect to assembly, applying the glue seal between the bag and the ring is a time-consuming operation and it is difficult to apply the glue to form a uniform, effective seal around the entire mouth of the bag. With respect to performance, the glue seal tends to deteriorate at high temperatures and humidity, which may cause dirt and dust to escape from the bag into the housing of the cleaner. Also, the glue tends to lose its holding strength in the event it becomes exposed to dirt.

SUMMARY OF THE INVENTION

Among the several objects of this invention may be noted the provision of an improved bag assembly for use in a vacuum cleaner of the type described above; the provision of such an assembly where the bag is non-adhesively secured (e.g., stitched) to a bag support to ensure an effective seal between the bag and the bag support around the entire mouth of the bag; the provision of such an assembly where the aforementioned seal retains its integrity under conditions of relatively high heat and humidity; the provision of such an assembly which is economical to manufacture; and the provision of such an assembly which is durable and easy to clean.

In general, a bag assembly of this invention is for a vacuum cleaner of the type having a housing defining a bag-receiving compartment, and a lid for closing an opening in the housing above the bag-receiving compartment. The bag assembly comprises a bag having a side wall with upper edge margins defining a bag mouth, and an annular bag support of synthetic resin material. The bag support has an annular wall with a generally vertical central axis, and an annular sealing formation adjacent the top of the wall. The upper edge margins of the bag are stitched to the annular wall of the bag support to provide a seal between the wall and the bag around the mouth of the bag. The bag assembly is adapted to be placed in the bag-receiving compartment of the vacuum cleaner and the lid moved to a closed position in which the annular sealing formation of the bag support is sealingly engageable with the housing.

In another aspect of this invention, the bag assembly comprises a bag having a side wall with upper edge margins defining a bag mouth, an annular bag support of synthetic resin material comprising an annular wall with a generally vertical central axis, and an annular sealing formation adjacent the top of the wall. The sealing formation extends generally laterally outwardly from the wall and defines an annular recess lying in a generally horizontal plane extending generally at right angles to the central axis. A stiffening ring is disposed concentrically around the outside of the annular wall of the bag support. The ring has an annular flange extending generally radially outwardly from the ring into the annular recess in the sealing formation. The upper edge margins of the bag are secured to the annular wall of the bag support to provide a seal around the mouth of the bag between the wall and the bag. The bag assembly is adapted to be placed in the bag-receiving compartment of the vacuum cleaner and the lid moved to a closed position in which the annular sealing formation on the bag support is sealingly engageable with the housing.

Other objects and features of this invention will be in part apparent and in part pointed out hereinafter.

BRIEF DESCRIPTION OF THE DRAWINGS

Corresponding parts are designated by corresponding reference numerals throughout the several views of the drawings.

DETAILED DESCRIPTION OF PREFERRED EMBODIMENTS

Figure 1:
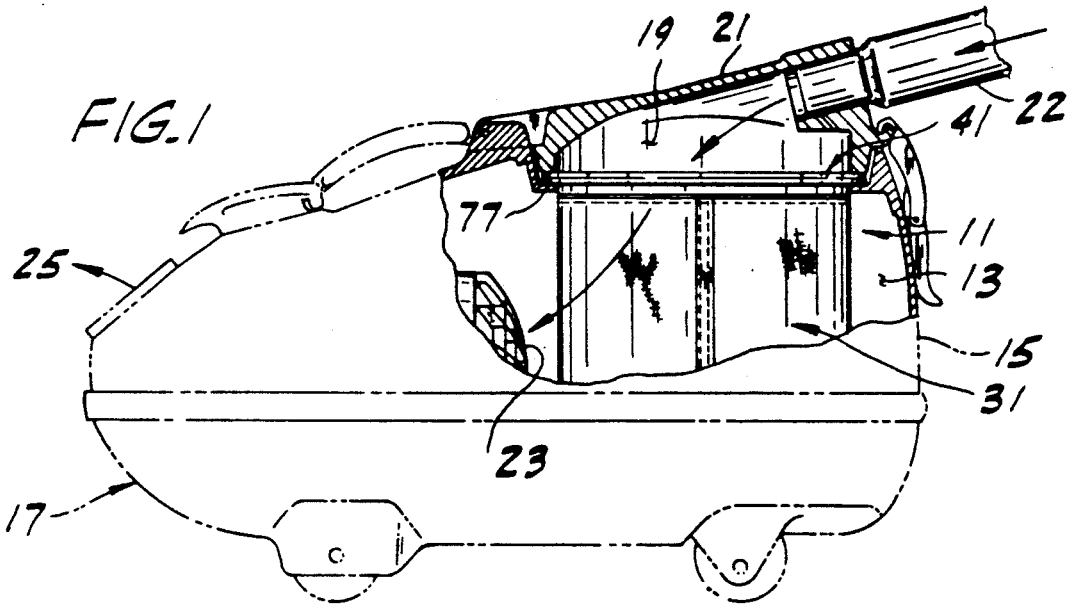
FIG. 1 is a side elevational view of a vacuum cleaner with portions of the housing broken away to reveal a bag assembly of this invention installed in the cleaner.

Referring now to the drawings, and particularly to FIG. 1, there is generally indicated at 11 a bag assembly of this invention shown installed in a bag-receiving compartment 13 in the housing 15 of a vacuum cleaner, the latter of which is generally designated 17. The housing of the cleaner has an opening 19 in it above the bag-receiving compartment. A lid 21 is hinged to the housing for moving between an open position and the closed position shown in FIG. 1. As indicated by the arrows, air is drawn through the hose 22 of the vacuum cleaner, down through the opening 19 in the housing into and through the bag assembly 11 where dirt and dust is filtered out of the air, and then into the intake of a blower 23 mounted in the housing. Air is exhausted from the blower to atmosphere at 25.

Figure 3:
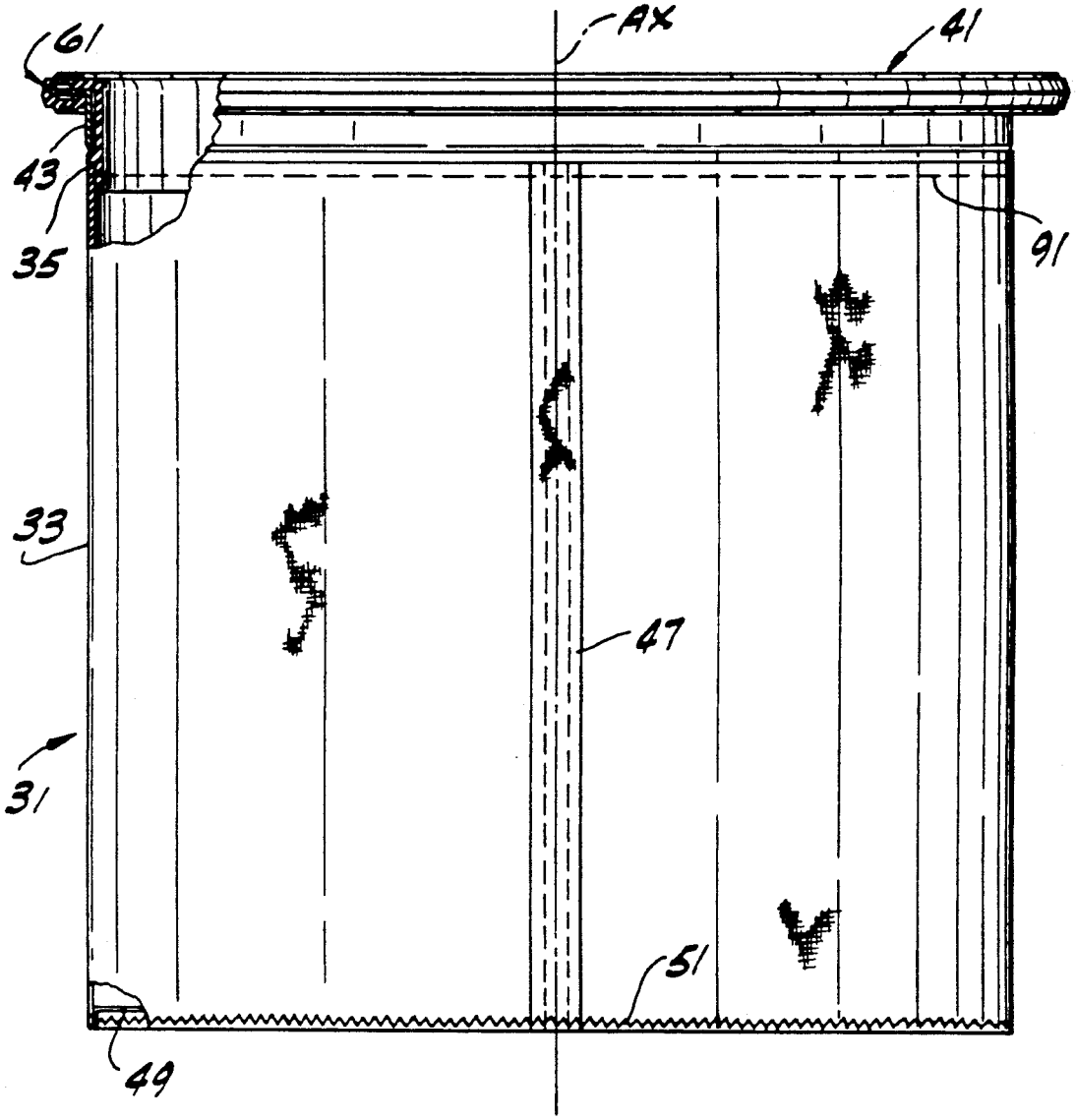
FIG. 3 is a side elevation of the bag assembly of this invention, portions being broken away to illustrate details.

The bag assembly 11 comprises a bag, generally designated 31, having a side wall 33 with upper edge margins 35 defining a bag mouth M, an annular support, generally designated 41, for supporting the bag, and a stiffening ring 43. The bag 31 is of air permeable material, such as a suitable cloth or fabric, and is preferably cylindric in shape, having a central vertical axis AX (see FIG. 3). The bag is formed to have overlapping side edge margins secured, as by stitching, to form a vertical seam indicated at 47. The bag has a bottom 49 formed by a separate panel of material stitched at 51 to the side wall 33 of the bag around its lower edge. The shape and construction of the bag 31 may vary without departing from the scope of this invention.

The bag support 41 is made of a flexible, resilient synthetic resin material, such as vinyl plastic, and is preferably of integral, one-piece construction. It has a cylindric annular wall 55 with a generally vertical central axis coincident with the axis AX of the bag 31, and an annular sealing formation, generally designated 61, adjacent the top of the wall extending laterally outwardly from the wall.

Figure 4:
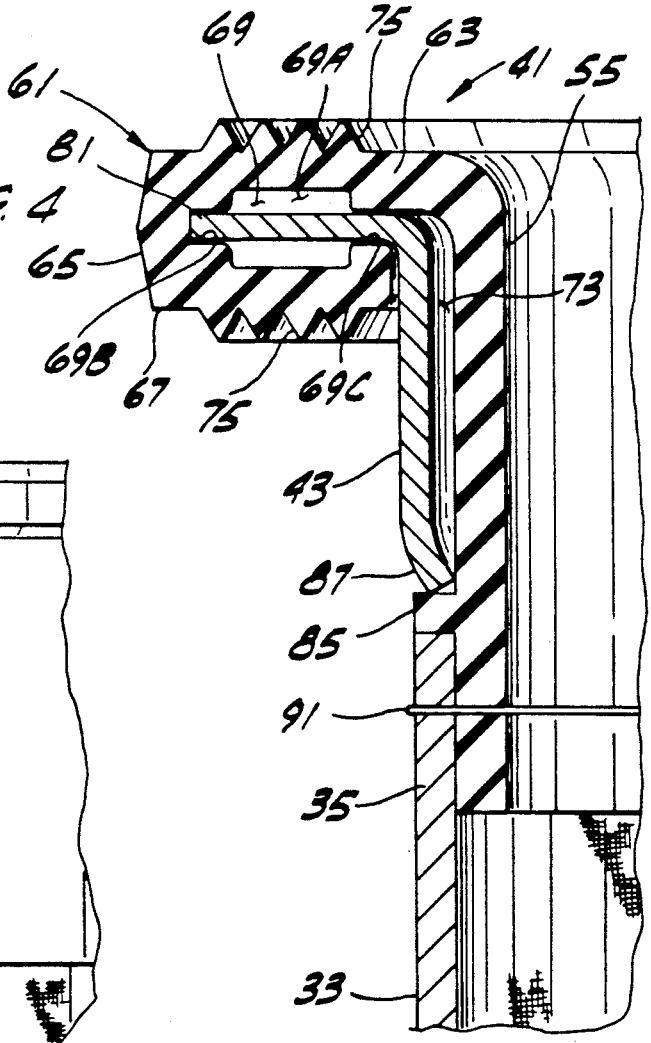
FIG. 4 is an enlarged sectional view of a portion of the bag assembly of FIG. 3.
Figure 2:
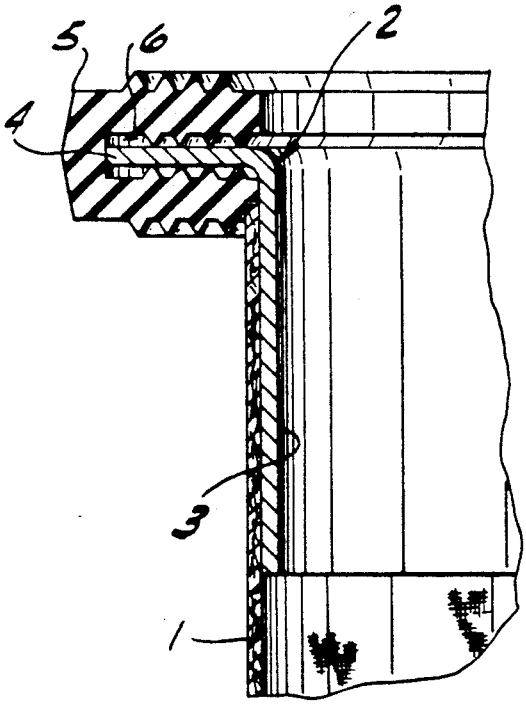
FIG. 2 PRIOR ART
FIG. 2 illustrates a prior bag assembly on which the present invention is an improvement.

As illustrated in FIG. 4, the sealing formation 61 comprises, in vertical section, an upper leg 63 extending generally horizontally outwardly from the top of the wall 55 of the bag support, an outer leg 65 depending generally vertically from the upper leg adjacent an outer end thereof, and a lower leg 67 extending generally horizontally inwardly from the outer leg. The lower leg 67 is spaced below the upper leg to define an annular recess 69 lying in a generally horizontal plane extending generally at right angles to the central axis AX of the bag support. As viewed in section (FIG. 4), the recess 69 has a relatively large rectangular central portion 69A, and two relatively narrow side extensions 69B, 69C at opposite sides of the central portion. The inner end of the lower leg is spaced from the annular wall of the support define a passage 73 which communicates with side extension 69C of the recess and through which part of the stiffening ring 43 may be inserted into the recess, as will appear.

The top and bottom surfaces of the upper and lower legs 63, 67, respectively, are integrally formed with annular concentric compression ribs 75. The ribs 75 on the lower leg 67 are engageable with an annular shoulder 77 in the housing 15 when the bag assembly 11 is placed in the bag-receiving compartment 13 of the vacuum cleaner 17 (see FIG. 1). The ribs 75 on the upper leg 63 are engageable by the lid 21 of the vacuum cleaner when the lid is closed. The arrangement is such that, when the lid is moved to its closed position, the sealing formation 61, including the compression ribs 75, are compressed to provide an air-tight seal between the housing 15 and the lid 21 of the vacuum cleaner to ensure a proper flow of air through the cleaner. The flexible resilience of the legs 63, 65, 67 of the sealing formation, and the presence of the recess 69, makes this seal effective within a reasonably wide range of dimensional tolerances.

Figure 6:
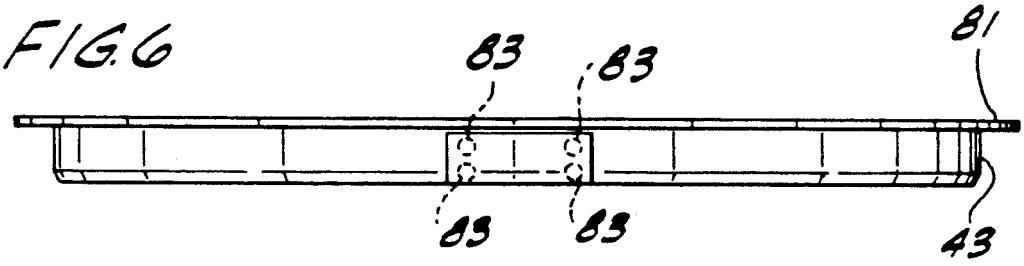
FIG. 6 is a side elevation of a stiffener ring of the bag assembly.
Figure 5:
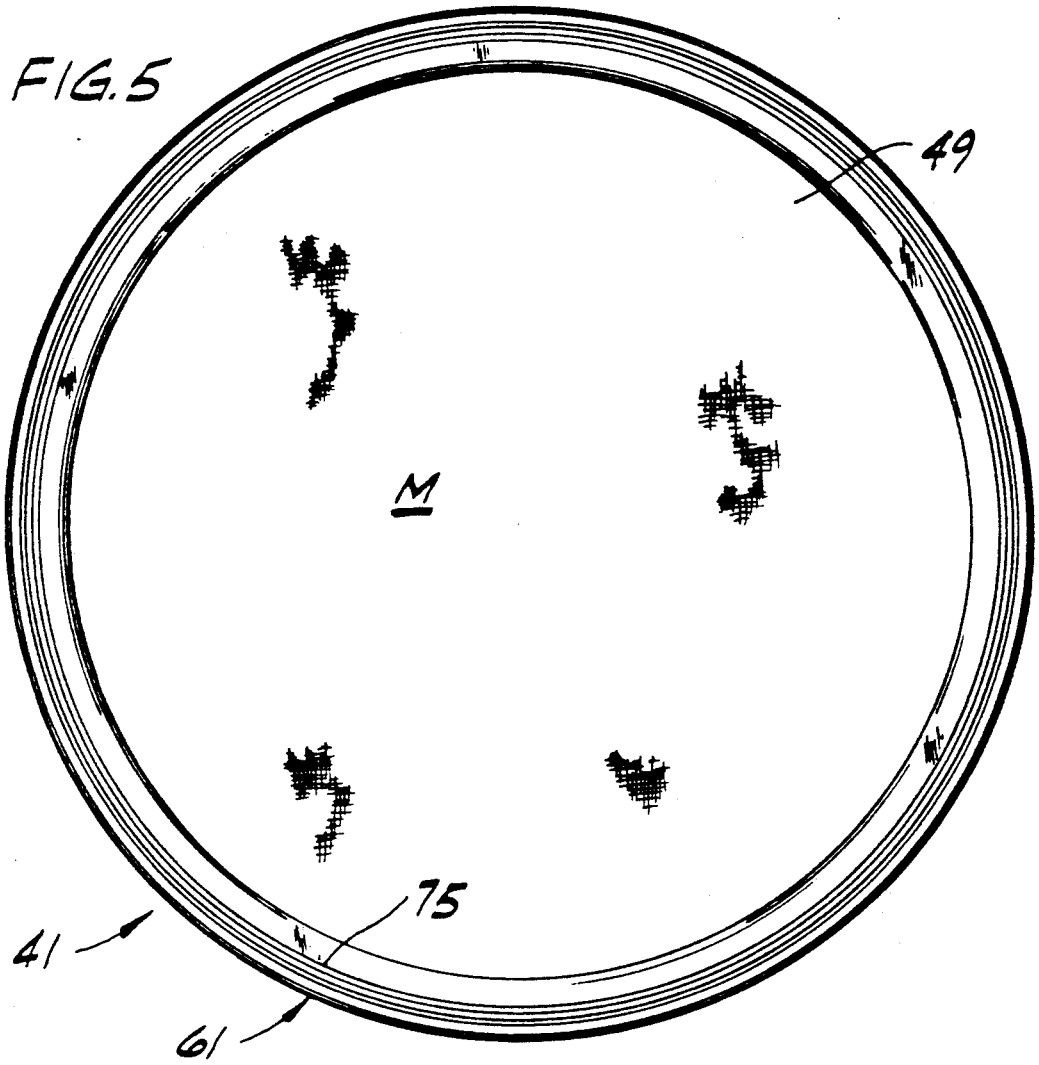
FIG. 5 is a top plan of the bag assembly shown in FIG. 3.

The stiffening ring 43 is disposed concentrically around the outside of the annular wall 55 of the bag support 41. The ring has an annular flange 81 extending radially outwardly from the ring, as best illustrated in FIG. 4. As shown, this flange 81 is receivable in the annular recess 69 defined by the annular sealing formation 61. The legs 63, 65, 67 of the formation are resiliently deformable to enable the flange to be inserted through the passage 73 and into the recess, where the outer edge of the flange 81 is receivable in the relatively narrow side extension 69B of the recess farthest from the passage. The stiffening ring 43 is preferably fabricated from sheet metal, such as 22 gage (0.031 in.) hot rolled steel sheet having a zinc finish. The ring may be formed from a strip of steel, generally L-shaped in transverse section, bent into the shape of a ring, with the ends of the strip affixed, as by spot welding (indicated at 83 in FIG. 6), in overlapping relation. Alternatively, the ring may be stamped as a single piece, integrally formed, from sheet steel. As viewed in FIG. 4, the lower end of the ring closely overlies an annular shoulder 85 extending laterally outwardly from the wall 55 of the bag support 41. The lower end of the stiffening ring may be turned radially inwardly, as indicated at 87, so that the sharp edges of the ring are positioned above the shoulder 85 and thus are not exposed during handling of the bag assembly.

In accordance with this invention, the upper margins 35 of the side wall 33 of the bag fit around the outside of the wall 55 of the bag support and are secured by means of stitching 91 to the wall with the upper edge of the bag closely adjacent and underlying the aforementioned annular shoulder 85 (this shoulder may also serve a positioning function to locate the bag relative to the bag support 41 during assembly prior to the stitching operation). The stitching extends completely around the bag mouth M so that the entire bag mouth is sealed to the wall to prevent dust and dirt from escaping the bag. Any suitable heavy-duty thread (e.g., polyester thread) or the like may be used, so long as it is sufficiently strong and durable. Also, the particular stitch used may vary without departing from the scope of this invention so long as the stitches are sufficiently close together to provide a proper seal. As explained earlier, the use of non-adhesive means such as stitching to secure the bag to the bag support eliminates the sealing problems associated with the use of glue.

Figure 7:
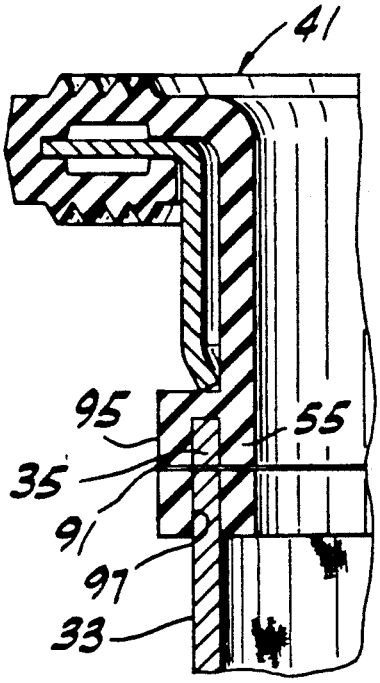
FIG. 7 is a view similar to FIG. 4 showing an alternative construction of the bag assembly.

FIG. 7 shows an alternative design which is identical to the design described above except that the annular shoulder on the bag support 41 is replaced by receiving means in the form of an L-shaped bag retainer 95 on the outside of the annular wall 55 of the bag support 41. In combination with wall 55, this retainer 95 defines a downwardly opening annular groove 97 for receiving the upper edge margins 35 of the bag therein. In this embodiment, the stitching 91 extends through the retainer 95, the upper edge margins 35 of the bag in the groove 97, and the wall 55 of the bag support. This design provides greater protection and strength to the seal between the bag and the bag support.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A bag assembly for a vacuum cleaner of the type having a housing defining a bag-receiving compartment, and a lid for closing an opening in the housing above the bag-receiving compartment, said bag assembly comprising a bag having a side wall with upper edge margins defining a bag mouth, an annular bag support of synthetic resin material, said bag support having an annular wall with a generally vertical central axis, and an annular sealing formation adjacent the top of the wall, and means stitching the upper edqe margins of the bag to the annular wall of the bag support to provide a seal between the wall and the bag around the mouth of the bag, said bag assembly being adapted to be placed in said bag-receiving compartment of said vacuum cleaner and the lid moved to a closed position in which the annular sealing formation on the bag support is sealingly engageable with the housing.

2. A bag assembly as set forth in claim 1 wherein said sealing formation extends generally laterally outwardly from the wall and defines an annular recess lying in a generally horizontal plane extending generally at right angles to said central axis, said bag assembly further comprising a stiffening ring concentrically disposed around the outside of the annular wall of the bag support, said ring having an annular flange extending generally radially outwardly from the ring into the annular recess in said sealing formation.

3. A bag assembly as set forth in claim 2 wherein the bag support is of integral, one-piece construction.

4. A bag assembly as set forth in claim 3 wherein said sealing formation comprises, in vertical section, an upper leg extending outwardly from the top of said annular wall of the bag support, an outer leg depending from the upper leg adjacent an outer end thereof, and a lower leg extending inwardly from the outer leg, said lower leg being spaced below the upper leg to define said recess, said legs being flexibly resilient to facilitate insertion of the annular flange of the stiffening ring into the recess.

5. A bag assembly as set forth in claim 4 wherein the inner end of said lower leg is spaced from the annular wall of the bag support to define a passage through which the annular flange of the stiffening ring may be inserted into said recess.

6. A bag assembly as set forth in claim 2 wherein the annular wall of the bag support has annular shoulder means thereon extending laterally outwardly from the wall, said bag being stitched to the wall with the upper edge of the bag closedly adjacent and underlying said shoulder.

7. A bag assembly as set forth in claim 1 further comprising receiving means on the outside of the annular wall of the bag support defining a downwardly opening annular groove for receiving the upper edge margins of the bag therein, said stitching means extending through said receiving means, the upper edge margins of the bag, and the wall of the bag support.

8. A bag assembly as set forth in claim 1 wherein said stitching means comprises thread stitched through the upper margins of the bag and through the wall of the bag support.

9. A bag assembly for a vacuum cleaner of the type having a housing defining a bag-receiving compartment, and a lid for closing an opening in the housing above the bag-receiving compartment, said bag assembly comprising a bag having a side wall with upper edge margins defining a bag mouth, an annular bag support of synthetic resin material comprising an annular wall with a generally vertical central axis, and an annular sealing formation adjacent the top of the wall, said sealing formation extending generally laterally outwardly from the wall and defining an annular recess lying in a generally horizontal plane extending generally at right angles to said central axis, and a stiffening ring concentrically disposed around the outside of the annular wall of the bag support, said ring having an annular flange extending generally radially outwardly from the ring into the annular recess in said sealing formation, the upper edge margins of the bag being secured to the annular wall of the bag support to provide a seal between the wall and the bag around the mouth of the bag, said bag assembly being adapted to be placed in said bag-receiving compartment and the lid moved to a closed position in which the annular sealing formation on the bag support is sealingly engageable with the housing.

10. A bag assembly as set forth in claim 9 wherein the bag support is of integral, one-piece construction.

11. A bag assembly as set forth in claim 10 wherein said sealing formation comprises, in vertical section, an upper leg extending outwardly from the top of said annular wall of the bag support, an outer leg depending from the upper leg adjacent an outer end thereof, and a lower leg extending inwardly from the outer leg, said lower leg being spaced below the upper leg to define said recess, said legs being flexibly resilient to facilitate insertion of the annular flange of the stiffening ring into the recess.

12. A bag assembly as set forth in claim 11 wherein the inner end of said lower leg is spaced from the annular wall of the bag support to define a passage through which the annular flange of the stiffening ring may be inserted into said recess.

13. A bag assembly as set forth in claim 9 wherein the annular wall of the bag support has annular shoulder means thereon extending laterally outwardly from the wall, said bag being secured to the wall with the upper edge of the bag closely adjacent and underlying said shoulder.

14. A bag assembly as set forth in claim 9 wherein said means for securing the upper edge margins of the bag to the wall of the bag support comprises stitching extending through the upper margins of the bag and through the wall of the bag support.

15. A bag assembly as set forth in claim 14 further comprising receiving means on the outside of the annular wall of the bag support defining a downwardly opening annular groove for receiving the upper edge margins of the bag therein, said stitching extending through said receiving means, the upper edge margins of the bag, and the wall of the bag support.

16. A bag assembly as set forth in claim 9 further comprising receiving means on the outside of the annular wall of the bag support defining a downwardly opening annular groove for receiving the upper edge margins of the bag therein.

* * * * *